US005368966A

United States Patent [19]

Nakamura et al.

[11] Patent Number: 5,368,966

[45] Date of Patent: Nov. 29, 1994

[54] PHOTOSENSITIVE MEMBER FOR ELECTROPHOTOGRAPHY WITH INDOLE DERIVATIVE

[75] Inventors: Yoichi Nakamura; Nobuyoshi Mori; Sumitaka Nogami, all of Kawasaki, Japan

[73] Assignee: Fuji Electric Co., Ltd., Kanagawa, Japan

[21] Appl. No.: 59,988

[22] Filed: May 12, 1993

[30] Foreign Application Priority Data

May 14, 1992 [JP] Japan ..... 4-120901
Jul. 6, 1992 [JP] Japan ..... 4-177254

[51] Int. Cl.[5] ..... G03G 5/09; G03G 5/047

[52] U.S. Cl. ..... 430/59; 430/78; 430/83

[58] Field of Search ..... 430/59, 78, 83

[56] References Cited

U.S. PATENT DOCUMENTS

| | | | |
|---|---|---|---|
| 3,189,447 | 6/1965 | Neugebauer et al. . | |
| 3,484,237 | 12/1969 | Shattuck et al. . | |
| 3,784,376 | 1/1974 | Fox | 430/78 |
| 3,816,118 | 6/1974 | Byrne . | |
| 4,150,987 | 4/1979 | Anderson et al. . | |
| 4,265,990 | 5/1981 | Stolka et al. | 430/59 |
| 4,278,747 | 7/1981 | Murayama et al. | 430/82 |
| 4,346,158 | 8/1982 | Pai et al. | 430/59 |
| 4,353,971 | 10/1982 | Chang et al. | 430/58 |
| 4,367,273 | 1/1983 | Murayama et al. | 430/56 |
| 4,385,106 | 5/1983 | Sakai | 430/59 |
| 4,415,640 | 11/1983 | Goto et al. | 430/59 |
| 4,448,868 | 5/1984 | Suzuki et al. | 430/58 |

(List continued on next page.)

FOREIGN PATENT DOCUMENTS 0034942 9/1981 European Pat. Off. .

OTHER PUBLICATIONS

Johnson, R. N., et al., "Poly(aryl Ethers) by Nucleophilic Aromatic Substitution. I. Synthesis and Properties", *Journal of Polymer Science*, Part A-1, vol. 5, pp. 2375–2398 (1967).

S. L. Rice et al, "A New Class of Photoconductive Transport Materials: Substituted Phenyl and Diphenyl Acetaldehyde Enamines", *Journal of Imaging Science*, vol. 29, No. 1, 1985, pp. 7–10.

P. J. Melz et al, "Use of Pyrazoline-based Carrier Transport Layers in Layered Photoconductor Systems for Electrophotography", *Photographic Science and Engineering*, vol. 21, No. 2, Mar./Apr. 1977, pp. 73–78.

*Primary Examiner*—Roland Martin
*Attorney, Agent, or Firm*—Spencer, Frank & Schneider

[57] ABSTRACT

A photosensitive member for electrophotography has a photosensitive layer provided on a photoconductive substrate. The photosensitive layer contains at least one of indole derivatives represented by a chemical formula (I):

(I)

wherein $R_1$ and $R_2$ are members selected from a group consisting of hydrogen atom and alkyl, aralkyl, allyl and alkoxy groups having 1–9 carbon atoms (but $R_1$ and $R_2$ do not stand for hydrogen atoms at the same time); $R_3$ is a member selected from a group consisting of hydrogen and halogen atoms and alkyl and alkoxy groups having 1–3 carbon atoms; X is a member selected from a group consisting of alkylen, allylen, carbonyl, sulfonyl, sulfinyl and sulfide groups and oxygen atom; and n stands for an integer of 0 or 1.

20 Claims, 1 Drawing Sheet

U.S. PATENT DOCUMENTS

| | | | |
|---|---|---|---|
| 4,565,761 | 1/1986 | Katagiri et al. | 430/83 |
| 4,568,623 | 2/1986 | Makino et al. | 430/58 |
| 4,606,986 | 8/1986 | Yanus et al. | 430/59 |
| 4,624,904 | 11/1986 | Kazmaier et al. | 430/59 |
| 4,629,670 | 12/1986 | Katagiri et al. | 430/58 |
| 4,629,672 | 12/1986 | Makino et al. | 430/76 |
| 4,666,809 | 5/1987 | Matsumoto et al. | 430/76 |
| 4,673,630 | 6/1987 | Katagiri et al. | 430/72 |
| 4,677,045 | 6/1987 | Champ et al. | 430/76 |
| 4,731,315 | 3/1988 | Horie et al. | 430/77 |
| 4,783,387 | 11/1988 | Ueda | 430/76 |
| 4,808,503 | 2/1989 | Yamada et al. | 430/75 |
| 4,833,054 | 5/1989 | Akasaki et al. | 430/59 |
| 4,839,252 | 6/1989 | Murata et al. | 430/59 |
| 4,861,691 | 8/1989 | Kuroda et al. | 430/59 |
| 4,861,692 | 8/1989 | Kuroda et al. | 430/59 |
| 4,865,934 | 9/1989 | Ueda et al. | 430/59 |
| 4,871,636 | 10/1989 | Hattori et al. | 430/77 |
| 4,877,703 | 10/1989 | Kuroda et al. | 430/76 |
| 4,882,255 | 11/1989 | Hattori et al. | 430/73 |
| 4,910,110 | 3/1990 | Kuroda et al. | 430/59 |
| 4,917,981 | 4/1990 | Nakamura et al. | 430/75 |
| 4,920,022 | 4/1990 | Sakakibara et al. | 430/59 |
| 4,929,525 | 5/1990 | Kuroda et al. | 430/75 |
| 4,935,323 | 6/1990 | Hattori et al. | 430/58 |
| 4,945,021 | 7/1990 | Takata et al. | 430/76 |
| 4,948,689 | 8/1990 | Kuroda et al. | 430/59 |
| 4,950,572 | 8/1990 | Kuroda et al. | 430/59 |
| 4,954,405 | 9/1990 | Sugata et al. | 430/58 |
| 4,956,250 | 9/1990 | Kuroda et al. | 430/58 |
| 4,956,255 | 9/1990 | Ueda | 430/59 |
| 4,956,277 | 9/1990 | Kuroda et al. | 430/58 |
| 4,957,837 | 9/1990 | Kuroda et al. | 430/59 |
| 4,971,876 | 11/1990 | Kuroda et al. | 430/75 |
| 4,985,325 | 1/1991 | Kuroda et al. | 430/59 |
| 4,988,594 | 1/1991 | Hattori et al. | 430/59 |
| 5,080,991 | 1/1992 | Ono et al. | 430/73 |
| 5,087,541 | 2/1992 | Kuroda et al. | 430/58 |
| 5,089,365 | 2/1992 | Kuroda et al. | 430/59 |
| 5,096,794 | 3/1992 | Kuroda et al. | 430/58 |
| 5,100,750 | 3/1992 | Kuroda et al. | 430/72 |
| 5,126,223 | 6/1992 | Kikuchi et al. | 430/59 |
| 5,132,189 | 7/1992 | Kuroda et al. | 430/58 |
| 5,134,049 | 7/1992 | Kuroda et al. | 430/58 |
| 5,158,848 | 10/1992 | Kuroda et al. | 430/59 |
| 5,178,981 | 1/1993 | Hattori et al. | 430/58 |
| 5,198,318 | 3/1993 | Kuroda et al. | 430/58 |
| 5,213,925 | 5/1993 | Kuroda et al. | 430/59 |

FOREIGN PATENT DOCUMENTS

| | | |
|---|---|---|
| 0131140 | 1/1985 | European Pat. Off. . |
| 0270685 | 6/1988 | European Pat. Off. . |
| 0347967 | 12/1989 | European Pat. Off. . |
| 2623638 | 11/1988 | France . |
| 1058836 | 6/1959 | Germany . |
| 1105714 | 4/1961 | Germany . |
| 1908343 | 8/1969 | Germany . |
| 1921273 | 11/1969 | Germany . |
| 2041490 | 3/1971 | Germany . |
| 2046914 | 8/1971 | Germany . |
| 2110971 | 12/1971 | Germany . |
| 2357851 | 6/1974 | Germany . |
| 2944949 | 6/1980 | Germany . |
| 3019909 | 11/1980 | Germany . |
| 3022545 | 1/1981 | Germany . |
| 3138292 | 5/1982 | Germany . |
| 3141306 | 6/1982 | Germany . |
| 3139524 | 8/1982 | Germany . |
| 3203621 | 9/1982 | Germany . |
| 3208337 | 9/1982 | Germany . |
| 3303830 | 8/1983 | Germany . |
| 3320674 | 12/1983 | Germany . |
| 3602987 | 10/1986 | Germany . |
| 3643341 | 6/1987 | Germany . |
| 3841207 | 6/1989 | Germany . |
| 3842253 | 6/1989 | Germany . |
| 10785 | 5/1972 | Japan . |
| 37543 | 12/1972 | Japan . |
| 47-344 | 7/1973 | Japan . |
| 25658 | 7/1973 | Japan . |
| 66444 | 12/1973 | Japan . |
| 69332 | 7/1974 | Japan . |
| 10496 | 4/1975 | Japan . |
| 39952 | 4/1975 | Japan . |
| 10138 | 1/1977 | Japan . |
| 27003 | 3/1978 | Japan . |
| 150128 | 11/1979 | Japan . |
| 138263 | 4/1980 | Japan . |
| 138264 | 4/1980 | Japan . |
| 138265 | 4/1980 | Japan . |
| 138266 | 4/1980 | Japan . |
| 153814 | 4/1980 | Japan . |
| 132965 | 9/1980 | Japan . |
| 55-42380 | 10/1980 | Japan . |
| 166557 | 11/1980 | Japan . |
| 12646 | 2/1981 | Japan . |
| 60433 | 5/1981 | Japan . |
| 104856 | 7/1981 | Japan . |

PHOTOSENSITIVE MEMBER FOR ELECTROPHOTOGRAPHY WITH INDOLE DERIVATIVE

BACKGROUND OF THE INVENTION

1. Field of the Invention

The present invention relates to a photosensitive member for electrophotography, and particularly to a photosensitive member having an electroconductive substrate and a photosensitive layer formed thereon, in which the photosensitive layer contains a novel indole derivative as a charge transporting substance.

2. Description of the Prior Art

Heretofore, photosensitive members for electrophotography have been prepared by using photosensitive substances selected from:

(i) inorganic photoconductive substances such as selenium, selenium alloys, and the like dispersed in resin binders;

(ii) organic photoconductive substances such as poly-N-vinylcarbazole, polyvinylanthracene, phthalocyanine compounds, bisazo compounds, and the like; and (iii) dispersion of such organic photoconductive substances in resin binders.

These conventional photosensitive members are classified into two types, mono- and multi-layer types, the former comprises a single photosensitive layer, while the latter comprises functionally distinguishable laminated photosensitive layers in which one contributes to generate an electric charge by absorbing irradiated light and the other contributes to transport the electric charge.

In recent years, however, organic photoconductive substances as described above have been put into practical use by virtue of their advantageous features for preparing flexible and light-weight photosensitive members which can be easily mass produced. In addition, there have been much more studies for developing the multi-layer type photosensitive members than the mono-layer one because the former can be easily modified or prepared by using appropriate raw materials so as to have desired or photosensitivities against specific wavelength. Therefore, such photosensitive members have been used in many kinds of electrophotographic devices such as photocopying machines, laser-beam printers, light-emitting diode printers, facsimile machines and the like. More recently, there have been demands for more improved electrophotographic devices, for example a miniaturized device without losing their standard- or high-speed printing or copying abilities. With the technical achievement of the miniaturization, a photosensitive drum to be equipped in such device should be also miniaturized so as to have a smaller diameter and to rotate at a high speed compared with those currently in use. Accordingly, the miniaturized drum may be used more frequently than the normal-size one to make up the printing or recording speed, and thus such drum may be also improved so as to have a high sensitivity against irradiated light and response it at a high speed.

Although the organic photoconductive substances have a number of advantageous features as described above with which inorganic photoconductive substances are not endowed, the fact is that there have been obtained no organic photoconductive substance fully satisfying all the characteristics required of a raw material to be processed into photosensitive member used in the above small-sized electrophotographic device. That is, particular problems involved in the substance have been concerned with a high durability against usage frequency over long period and a high rate of response to illuminated light. To solve these problems, several photosensitive members have been proposed. Most of them comprise functionally distinguishable photosensitive layers. In a document of Japanese Patent Application Publication No. 55-42380, a photosensitive member having functionally distinguished photosensitive layers in which one is a charge generating layer comprising chlorodian blue as a charge generating substance and the other is a charge transporting layer comprising hydrazone compound as a charge transporting substance. A response rate and a durability of this kind of the photosensitive member are mainly depended on the charge transporting layer.

Several substances that can be applicable to the charge transporting layer has been described in the references, for example pyrazorine derivatives disclosed in Journal of Photographic Science and Engineering vol. 21, No. 2, page 73, 1977; enamine derivatives disclosed in Journal of Imaging Science vol. 29, No. 1, page 7, 1985 and Japanese Patent Application Laying-open No. 63-170651; and benzidine derivatives disclosed in documents of Japanese Patent Application Laying-open No. 3-43744 and Japanese Patent Application Laying-Open No. 59-9049.

Under the present circumstances, the conventional charge generating layers do not satisfy the request of providing the photosensitive members with excellent durabilities against usage in frequency over long period and with sufficient rates of response to irradiated light.

SUMMARY OF THE INVENTION

An object of the present invention is to provide a photosensitive member for electrophotography to be used in copying or recording devises and printers having their high photosensitive properties, high-speed response properties against the illuminated light and excellent characteristics including durabilities in repeated use in the state of their applications.

There is provided a photosensitive member for electrophotography comprising:

a conductive substrate having an electroconductive surface thereof: and a photosensitive layer laminated on the conductive substrate and containing at least one of indole derivatives represented by a chemical formula (I):

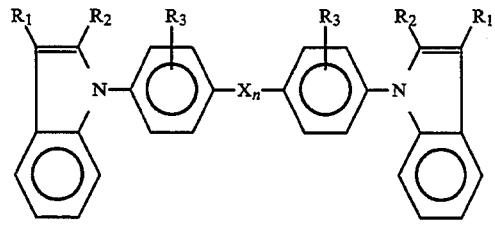

(I)

wherein $R_1$ and $R_2$ are members selected from a group consisting of hydrogen atom and alkyl, aralkyl, allyl and alkoxy groups having 1–9 carbon atoms (but $R_1$ and $R_2$ do not stand for hydrogen atoms at the same time); $R_3$ is a member selected from a group consisting of hydrogen and halogen atoms and alkyl and alkoxy groups having 1–3 carbon atoms; X is a member selected from a group consisting of alkylen, allylen, carbonyl, sulfonyl, sulfinyl and sulfide groups and oxygen atom; and n is an integer of 0 or 1.

Here, the $R_1$ may stand for a methyl group, $R_2$ may stand for a methyl group and $R_3$ may stand for hydrogen atom in the chemical formula (I) of the at least one of indole derivatives.

The $R_1$ may stand for a hydrogen atom, $R_2$ may stand for a methyl group and $R_3$ may stand for a hydrogen atom in the chemical formula (I) of the at least one of indole derivatives.

The $R_1$ may stand for a methyl group, $R_2$ may stand for a hydrogen atom and $R_3$ may stand for a hydrogen atom in the chemical formula (1) of the at least one of indole derivatives.

The conducting substrate may be made of a metallic material selected from aluminum, stainless steel and nickel.

The conducting substrate may be made of a non-conductive material having a surface treated to be electroconductive by a treatment selected from a metal deposition, a metal plating and an application of an electroconductive paint.

The photosensitive layer may be a monolayer-type thereof consisting of a single layer having functions of maintaining a surface electric charge in the dark, generating electric charge upon receiving light, and transporting the electric charge upon receiving light.

The monolayer-type photosensitive layer may have a thickness of 10–40 μm, and preferably of 20–30 μm.

The monolayer-type photosensitive layer may comprise 10–100 weight % of a charge transporting substance and 1–10 weight % of a charge generating substance.

The charge generating substance and the charge transporting substance are dispersed in a binder resin.

The binder resin may be an electrical-insulating laminatable material selected from a group of polycarbonates, polyesters, polyamides, polyurethanes, epoxy resins, methacrylate homo- and co-polymers, and mixtures thereof.

The charge transporting substance may be a compound selected from indole derivatives represented by the chemical formula (I) .

The charge generating substance may be selected from a group of metal-free phthalocyanine and titanylphthalocyanine, azo, quinone and indigo pigments, cyanine, squalilium, azulenium and pyrylium compounds, and selenium and selenium compounds.

The photosensitive layer may be a laminate-type thereof consisting of functionally distinguishable laminated layers:

an electric charge generating layer comprising a charge generating substance for generating electric charge; and a charge transporting layer comprising a charge transporting substance for transporting the electric charge upon receiving light.

A dry thickness of the charge generating layer may be in the range from 0.01 to 3.0 μm, and preferably from 0.01 to 1.0 μm.

A dry thickness of the charge transporting layer may be in the range from 5 to 50 μm, and preferably from 10 to 40 μm.

The charge transporting layer may be formed on the charge generating layer by using 10–100 weight % of the charge transporting substance and more than 30 weight of the resin binder per a total volume of the charge transporting layer.

The charge transporting substance may be a compound selected from indole derivatives represented by the chemical formula (I).

The charge generating substance may be selected from a group of metal-free phthalocyanine and titanylphthalocyanine, azo, quinone and indigo pigments, cyanine, squalilium, azulenium and pyrylium compounds, and selenium and selenium compounds.

The above and other objects, effects, features and advantages of the present invention will become more apparent from the following description of embodiments thereof taken in conjunction with the accompanying drawings.

DETAILED DESCRIPTION OF PREFERRED EMBODIMENTS

Figure 1:
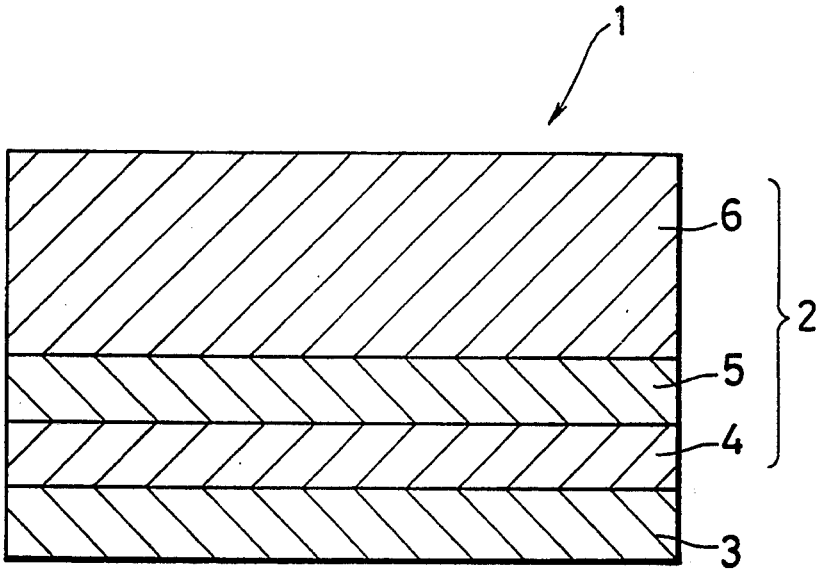
FIG. 1 shows a cross sectional plan view of a photosensitive member in accordance with the present invention.

As shown in FIG. 1, a photosensitive member 1 in accordance with the present invention comprises a photosensitive layer 2 applied on an electroconductive substrate 3. In this figure, the electroconductive substrate is covered with an under coating layer 4 such as a 5% methanol solution of polyamide resin or the like.

The electroconductive substrate 3 serves as an electrode of the photosensitive member 1, and as a support for the photosensitive layer 2 formed thereon. Also, the electroconductive substrate 3 may be in the form of a cylinder, a plate or a film, and may be made of a metallic material such as aluminum, stainless steel nickel or the like, or other material such as plastics, glass, paper or the like having a surface treated to be electroconductive by means of metallization, metal plating, electroconductive coating or the like.

The photosensitive layer 2 may be selected from mono- and multi-layer types thereof as described above.

In the case of the multi-layer type photosensitive layer, an organic or inorganic charge generating substance is formed as a charge generating layer 5 on the electroconductive substrate 3 by means of vacuum evaporation or applying and drying a dispersion of the charge generating substance in a solvent and/or a resin binder on the substrate. It is important that the charge generating layer 5 be high not only in charge generating efficiency but also in capability of injecting the generated electric charge into a charge transporting layer 6. Therefore the charge generating substance may be selected from: inorganic charge generating substances such as selenium, selenium-tellurium, selenium-arsenic, and the like; and organic charge generating substances such as azo pigment, squalilium pigment, pyrylium pigment, perylene pigment, anthanthrone pigment, phthalocyanine pigment, titanylphthalocyonine pigment, and the like, but not limited to those substances. Among them, a suitable substance should be chosen depending on a wavelength of irradiated light to be used. A dry thickness of the charge generating layer 5 may be determined depending on an extinction coefficient of the charge generating substance to be used therein in view of layer's function of generating the electric charge, but it is generally in the range from 0.01 to 3 μm, and preferably from 0.01 to 1.0 μm. It may be also possible to form a charge generating layer 5 using a charge generating substance as a main component in admixture with a charge transporting substance and so on. Resin binders usable in the charge generating layer 5 may be selected from materials which can be easily formed as electrical insulating films. The materials include polycarbonates, polyesters, polyamides, polyurethanes, epoxy resins, silicone resins, and methacrylate homopolymer and copolymers, which may be used either alone or in appropriate combination. It is preferable to use 10–300 weight % of the resin binder per a total volume of the charge generating layer. It may be possible to add an additional agent such as a (for example, paraffin halide), a fluidizing agent (for example, silicone resin), a pin-hole preventive agent (for example, dimethyl phthalate) and the like.

The charge transporting layer 6 is made of compound having a composition represented by the following chemical formula (I):

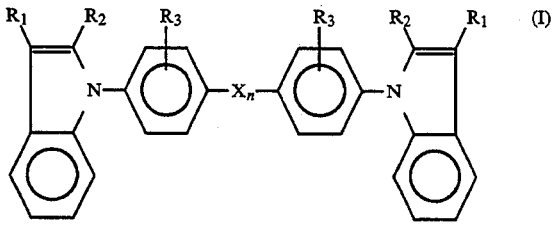

wherein $R_1$ and $R_2$ are members selected from the group consisting of hydrogen atom and alkyl, aralkyl and alkoxy groups having from 1 to 9 carbon atoms (but $R_1$ and $R_2$ do not stand for hydrogen atoms at the same time); $R_3$ is a member selected from the group consisting of hydrogen atom and alkyl, alkoxy and halogen radicals having from 1 to 3 carbon atoms; X is a member selected from the group consisting of alkylen, arylen, carboxyl, sulfonyl, sulfinyl and sulfide groups and oxygen atom; and n is an integer of 0 or 1.

Concrete embodiments of the compound of the chemical formula (I) are indicated in Tables 1 and 2.

TABLE 1

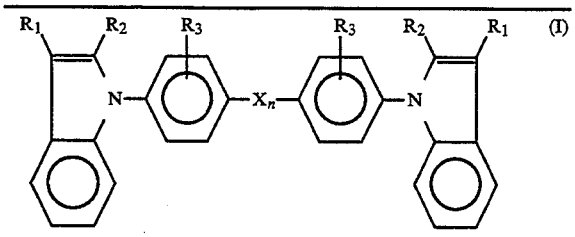

| FORMULA | $R_1$ | $R_2$ | $R_3$ | X | n |
|---|---|---|---|---|---|
| I-1 | $-CH_3$ | $-CH_3$ | —H | — | 0 |
| I-2 | 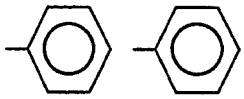 | | —H | — | 0 |
| I-3 | $N(C_2H_5)_2$ 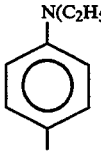 | 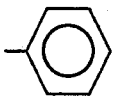 | —H | — | 0 |
| I-4 | 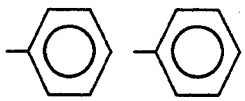 | | —H | —O— | 1 |

TABLE 1-continued

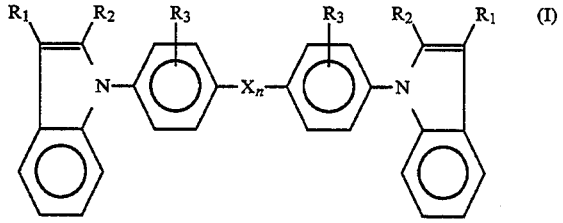

| FORMULA | $R_1$ | $R_2$ | $R_3$ | X | n |
|---|---|---|---|---|---|
| I-5 | $-CH_3$ | $-CH_3$ | —H | $-CH_2-$ | 1 |
| I-6 | $OCH_3$ | $OCH_3$ | —H | —S— | 1 |
| I-7 | 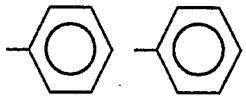 | | —H | —SO— | 1 |
| I-8 | 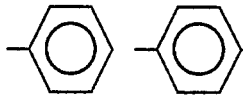 | | —H | —CO— | 1 |
| I-9 | 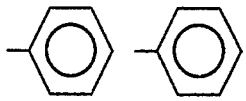 | | —H | $-SO_2-$ | 1 |

TABLE 2

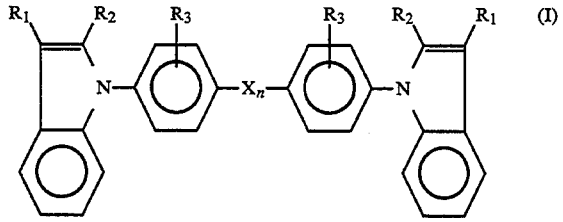

| FORMULA | $R_1$ | $R_2$ | $R_3$ | X | n |
|---|---|---|---|---|---|
| I-10 | —H | $-CH_3$ | —H | — | 0 |
| I-11 | $-CH_3$ | —H | —H | — | 0 |
| I-12 | —H | 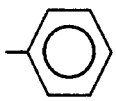 | —H | — | 0 |
| I-13 | —H | $OCH_3$ 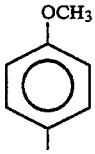 | —H | — | 0 |
| I-14 | —H | $-CH_3$ | —H | —O— | 1 |
| I-15 | —H | $-CH_3$ | —H | —S— | 1 |
| I-16 | —H | $-CH_3$ | $-CH_3$ | — | 0 |

TABLE 2-continued

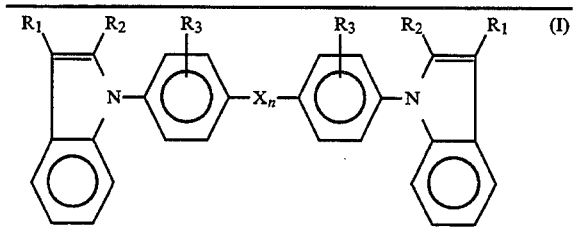

| FORMULA | $R_1$ | $R_2$ | $R_3$ | X | n |
|---|---|---|---|---|---|
| I-17 | —H | 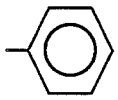 | —H | 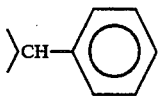 | 1 |
| I-18 | —H | $-C_2H_5$ | —H | 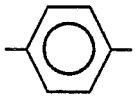 | 1 |

Alternatively, one selected from these charge transporting substance may be applied on the electroconductive substrate with other kind of charge transporting substance such as hydrazone compounds, styryl compounds, butadiene compounds, enamine compounds, diamine compounds, benzidine compounds, tryphenylmethane compounds, pyrazoline compounds, and the like.

The charge transporting layer 6 serves as an insulator layer in the dark so as to retain the electric charge of the photosensitive member 1, and fulfills, a function of transporting the electric charge injected from the charge generating layer 5 upon receiving light. The charge transporting layer 6 is prepared by the steps of: dissolving the charge transporting substance indicated by the chemical formula (I) with a resin binder in a solvent to make a coating solution; applying the coating solution on the electroconductive substrate; and drying the coating solution to form a layer 6. Resin binders usable in the charge transporting layer 6 include polycarbonate resin, polyester resin, acrylic resin, styrene resin, and the like but not limited to these resins.

For applying the appropriate charge transporting layer 6 on the charge generating layer 5, it is preferable to use 10–100 weight % of the charge transporting substance and more than 30 weight % of the resin binder per a total volume of the charge transporting layer 6. In general, a dry thickness of the charge transporting layer is in the range from 5 to 50 μm, preferably from 10 to 40 μm. It may be possible to add an additional agent such as a UV absorbent, an antioxidant, a plasticizer, a fluidizing agent, and the like.

In the case of the mono-layer type photosensitive layer, a charge generating substance and a charge transporting substance are comprised in one layer. The charge generating substance is selected from the group as described above, while the charge transporting substance is a compound having a composition represented by the chemical formula (I). In general, 10–100 weight % of the charge transporting substance per a total volume of the charge transporting layer may preferably be comprised. For preparing a photosensitive member, these charge generating and transporting substances are dispersed in a resin binder such as polyvinyl resin (polyvinylformal, polyvinylacetal, polyvinylbutyral), acrylic resin, polyester resin, polycarbonate resin, vinyl chloride copolymerized resin, vinyl acetate copolymerized resin, silicone resin, or the like to make a coating solution to be applied on the electroconductive substrate and dried. It may be possible to add an additional agent such as a UV absorbent, an antioxidant, a plasticizer, a fluidizing agent, and the like.

In the case of the mono-layer type photosensitive layer, 1–10 weight % of the charge generating substance may be preferably comprised therein because a photosensitivity of the layer is decreased when an amount of the substance is less than 1 weight %, while a percentage of electrification is decreased when the amount of the material is more than 10 weight %. Generally, the monolayer type of photosensitive layer is formed so as to have a thickness of 10–40 μm, preferably 20–30 μm in practice.

A charge transporting substance having a composition represented by the chemical formula (I) can be easily synthesized by a condensation between a halogen derivative of a phenyl compound and an indole compound. For example, a compound having a composition represented by a chemical formula (I-2) can be synthesized by a condensation between 2,3-diphenylindole (it is prepared from 2-phenylacetophenone and phenylhydrazine by Ficher-indole method) and 4,4'-dibromophenyl in a solvent such as sulfolane or the like in the presence of potassium carbonic anhydride and powder copper by heating at 200°–400° C. A condensed product may be purified by silica gel chromatography. In addition, a compound indicated by a chemical formula (I-1) or (I-2) can be also synthesized by almost the same process as described above, in which an indole compound prepared from a suitable ketone compound and phenylhydrazine is reacted with 4,4'-dihalogenbiphenyl.

A compound indicated by a chemical formula (I-4) can be synthesized by a reaction between 4-bromophenylether and a suitable indole derivative. The other compounds may be also synthesized by almost the same process as described above.

A method of synthesizing the compound of the chemical formula (I-2) are now described as follows.

269 g of 2,3-diphenylindole prepared from 2-phenylacetophenone and phenylhydrazine by the Ficher-Indole method, 156 g of 4,4'-dibromophenyl, 250 g of potassium carbonic anhydride and 30 g of powder copper are dissolved in 1500 ml sulfolane. A mixture thus obtained is refluxed in a nitrogen atmosphere at 240° C. for 24 hours. After that, the mixture is cooled and increased its volume by adding an appropriate amount of water. Then the water portion of the mixture was gently removed by decantation and this step was repeated 5 times. Furthermore, an appropriate amount of ethanol was added in the mixture and then it heated and washed by the reflux for two times to obtain a residual portion. The residual portion was suspended in a toluene/n-hexane mixture solvent and extracted under a thermal condition. An extracted solution was purified with a column chromatography, and then a molecular weight of the sample was estimated as 679.4 with a device of mass spectrophotometry (Nippon Denshi, FDMS (JMS-AX500)) . Furthermore, the sample was subjected into an elementary analysis and obtained results were listed in Table 3.

TABLE 3

| | A percentage of each element in the sample | | |
|---|---|---|---|
| | Carbon | Hydrogen | Nitrogen |
| measured value | 91.0 | 5.10 | 3.90 |
| calculated value | 90.7 | 5.23 | 4.07 |

A compound indicated by a chemical formula (I-10) may be synthesized by a heat reaction between 2-methylindole and 4,4'-dichlorobiphenyl in the presence of potassium carbonate and a copper compound catalyst in an inactive solvent.

A concrete example of preparing the compound (I-10 ) is as follows.

131 g of 2-methylindole, 156 g of 4,4'-dichlorobiphenyl, 230 g of potassium carbonic anhydride, and 50 g of copper metallocene are added in 100 ml of sulforan anhydride to react them for 50 hours at 150° C. After that, an appropriate amount of water is added in the reaction mixture to cool it down. This step is repeated 10 times and then the sample is suspended and extracted in a toluene/n-hexane mixture solvent and purified by recrystallization.

A molecular weight of the sample was estimated to 410 with a device of mass spectrophtometry (Nippon Denshi, FDMS(JMS-AX500)) and was subjected into an elementary analysis. Results of the analysis were listed in Table 4.

TABLE 4

| | A percentage of each element in the sample | | |
|---|---|---|---|
| | Carbon | Hydrogen | Nitrogen |
| measured value | 88.0 | 5.10 | 6.90 |
| calculated value | 87.6 | 5.70 | 5.70 |

EXAMPLE 1

An aluminum cylinder having a mirror-grinded surface (an outer diameter of 60 mm, a length of 348 mm and a thickness of 1 mm) was used.

The cylinder was dipped into 5% methanol solution of polyamide resin (Amiran CM-8000; manufactured by Toray Industries, Inc.) to cover a surface of the cylinder with an under coating layer having a thickness of 0.5 μm.

The cylinder having the under coating layer was further dipped into a solution containing a charge generating substance so as to provide a charge generating layer having a dry thickness of 0.4 μm on the under coating layer. This solution was prepared by dispersing 21 parts by weight of diazo dye having a composition represented by the following chemical formula (II), 1.0 parts by weight of polyvinylacetal (Eslex KS-1; manufactured by Sekisui Chemical Co., LTD. ), 16 parts by weight of methylethylketone and 9 parts by weight of cyclohexanone by sand mill to prepare a dispersion, and adding 75 parts by weight of methylethylketone to the dispersion.

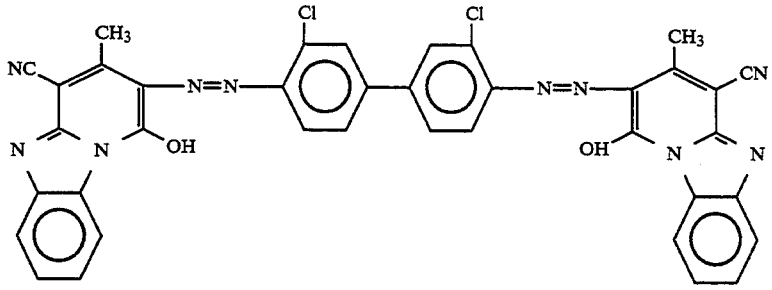

(II)

After that, a solution comprising 10 parts by weight of the indole derivative having the chemical formula (I-1) as a charge transporting substance and 10 parts by weight of polycarbonate resin (Iupilon PCZ-300; manufactured by Mitsubishi Gas Chemical Company Inc.), in which both compounds were dissolved in 80 parts by weight of dichloromethane, was applied to a surface of the charge generating layer and dried at 120° C. for 40 minutes to laminate a charge transporting layer having a dry thickness of 20 μm on the charge generating layer, resulting that a photosensitive layer was formed.

EXAMPLES 2, 4 AND 5

A photosensitive member was prepared by the same manner as described in the Example 1, except that a charge transporting substance having a chemical formula (I-2), (I-4) or (I-6) was used instead of the substance having the chemical formula (I-1) in the Example 2, 4, or 5, respectively.

COMPARATIVE EXAMPLES 1, 2 AND 5

A photosensitive member was prepared by the same manner as described in the Example 1, except that a charge transporting substance having a chemical formula (III), (IV) or (VII) was used instead of the substance having the chemical formula (I-1) in the Comparative Example 1, 2, or 5, respectively.

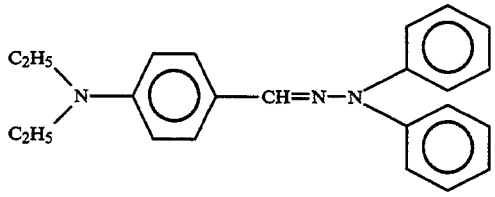

(III)

-continued

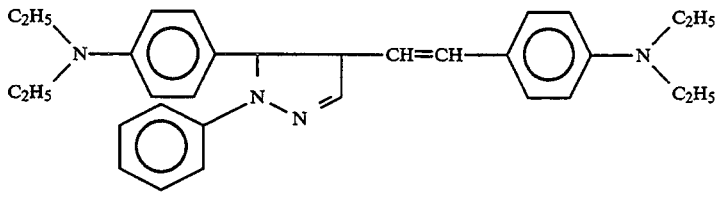

(IV)

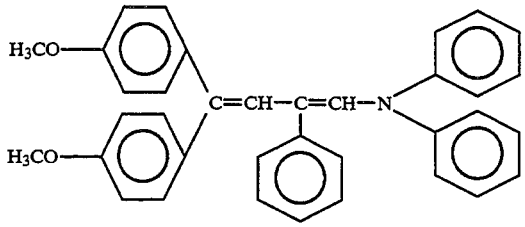

(V)

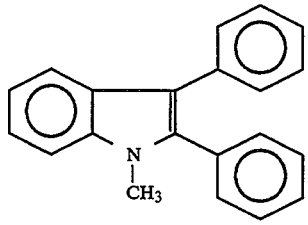

(VI)

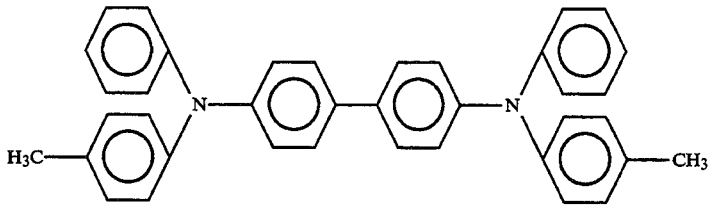

(VII)

EXAMPLES 3, 5, 7, 8 AND 9

An aluminum cylinder (an outer diameter of 60 mm, a length of 348 mm and a thickness of 1 mm) having a surface with a mean roughness (Rz) of 1.2 μm was used.

The cylinder was dipped into 5% methanol solution of polyimide resin (Amiran CM-4000; manufactured by Toray Industries, Inc.) to cover a surface of the cylinder with an under coating layer having a thickness of 0.1 μm.

The cylinder having the under coating layer was further dipped into a solution containing a charge generating substance so as to provide a charge generating layer having a dry thickness of 0.7 μm on the under coating layer. This solution was prepared by dissolving 1 part by weight of X-type metal-free phthalocyanine (Fastgen Blue 8120B; manufactured by Dainippon Ink and Chemicals Inc.) and 1 part by weight of vinyl chloride resin into 80 parts by weight of chloroform, followed by dispersing the mixture by paint shaker for 30 minutes.

After that, a solution comprising 10 parts by weight of charge transporting substance having a composition represented by the chemical formula (I-3) (I-5) , (I-7), (I-8) or (I-9) and 10 parts by weight of polycarbonate resin (Iupilon PCZ-300; manufactured by Mitsubishi Gas Chemical Company Inc.), in which both compounds were dissolved in 80 parts by weight of dichloromethane, was applied to a surface of the charge generating layer by a dip coating method and dried at 120° C. for 40 min to laminate a charge transporting layer having a dry thickness of 25 μm on the charge generating layer, resulting that a photosensitive layer was formed.

Then, a coating solution comprising 10 parts by weight of a charge transporting substance having a composition represented by the chemical formula (I-5), (I-5), (I-7), (I-8) and (I-9) and 10 parts by weight of polycarbonate resin (Iupilon PCZ-300; Mitsubishi Chemical Company Inc.), in which both compounds were dissolved in 80 parts by weight of dichloromethane, was coated on the above charge generating layer to provide a photosensitive member.

COMPARATIVE EXAMPLES 3 AND 4

A photosensitive member was prepared by the same manner as described in the Example 3, except that a charge transporting substance having a composition represented by a chemical formula (V) or (VI) was used instead of the formula (III) in the Comparative Example 3 or 4, respectively.

The electrophotographic characteristics of the photosensitive members thus obtained in the Examples 1, 2, 4 and 6 and the Comparative Examples 1, 2 and 5 were evaluated by using a photocopying machine (manufactured by Matsushita Electric Industrial Co., LTD.) which was already on the market.

Initial dark and bright potential of the photosensitive member were fixed at −800 V and −100 V, respectively, while a sensitivity of the photosensitive member was determined as a luminous energy enough to shift the dark potential to the bright potential by changing the strength of an illuminated light. In addition, a level of the potential after the emission of light(10 lx.s) was defined as a residual voltage (Vr). The sensitivity and the residual potential were measured at first and after 20,000 repetitions of the above determination. Obtained results were listed in Table 5.

TABLE 5

| | Initial period | | After the 20,000 repetitions | |
|---|---|---|---|---|
| | sensitivity (lx · s) | Vr (V) | sensitivity (lx · s) | Vr (V) |
| Examples | | | | |
| 1 | 1.2 | −10 | 1.3 | −10 |
| 2 | 0.9 | −8 | 1.0 | −8 |
| 4 | 0.7 | −14 | 1.0 | −15 |
| 6 | 0.7 | −8 | 1.0 | −15 |
| Comparative Examples | | | | |
| 1 | 2.0 | −9 | 3.0 | −10 |
| 2 | 1.1 | −11 | 2.0 | −100 |
| 5 | 0.8 | −5 | 1.9 | −150 |

The electrophotographic characteristics of photoconductive members obtained in the Examples 3, 5, 7, 8 and 9 and the Comparative Examples 3 and 4 were evaluated by using a device of photoconductive member process examination in which each member was installed as a sample. The sample was charged by corotoron to a potential of −60 V, and then it was rotated at a peripheral speed of 78.5 mm/second. A potential at a period before the illumination was defined as an initial potential. The photosensitive member was exposed by light having a wavelength of 780 nm at a strength of 2 $\mu J/cm^2$. A bright potential (Vi) and a residual potential (Vr) were measured at 0.2 and 1.5 seconds after the illumination, respectively. These potential were measured at first and after 20,000 repetitions of the above determination. Obtained results were listed in Table 6.

TABLE 6

| | Initial period | | | After the 20,000 repetitions | | |
|---|---|---|---|---|---|---|
| | Vo (V) | Vi (V) | Vr (V) | Vo (V) | Vi (V) | Vr (V) |
| Examples | | | | | | |
| 3 | −610 | −40 | −4 | −600 | −40 | −5 |
| 5 | −600 | −35 | −3 | −590 | −38 | −5 |
| 7 | 590 | −34 | 0 | −580 | −39 | −3 |
| 8 | −600 | −38 | −5 | −600 | −40 | −9 |
| 9 | −620 | −50 | −8 | −600 | −55 | −10 |
| Comparative Examples | | | | | | |
| 3 | −600 | −30 | −10 | −550 | −90 | −40 |
| 4 | −600 | −25 | 0 | −590 | −100 | −50 |

As shown in the tables 5 and 6, the photoconductive members using charge transporting substances in accordance with the present invention exhibited excellent photosensitivities without losing their stable characteristics after frequent usage over long period.

EXAMPLES 10, 12, 14, 16 AND 18

An aluminum cylinder having a mirror-grinded surface (an outer diameter of 80 mm, a length of 348 mm and a thickness of 1 mm) was used.

The cylinder was dipped into 5% methanol solution of polyimide resin (Amiran CM-8000; manufactured by Toray Industries, Inc.) to cover a surface of the cylinder with an under coating layer having a thickness of 0.5 μm.

The cylinder having the under coating layer was further dipped into a solution containing a charge generating substance so as to provide a charge generating layer having a dry thickness of 0.4 μm on the under coating layer. This solution was prepared by dispersing 21 parts by weight of diazo dye having a composition represented by the following chemical formula (II), 1.0 parts by weight of polyvinylacetal (Eslex KS-1; manufactured by Sekisui Chemical Co., LTD.), 16 parts by weight of methylethylketone and 9 parts by weight of cyclohexanone by sand mill to prepare a dispersion, and adding 75 parts by weight of methylethylketone to the dispersion.

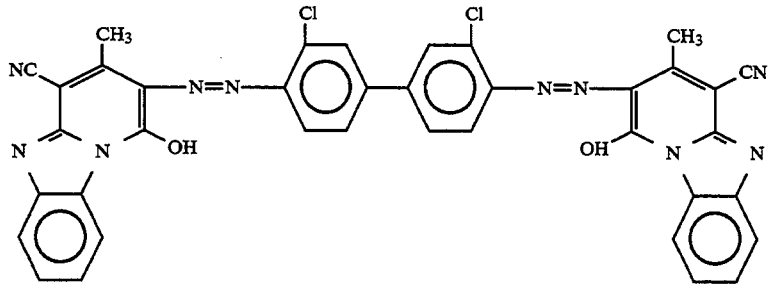

(II)

After that, a solution comprising 10 parts by weight of the indole derivative having the chemical formula (I-10), (I-12), (I-14), (I-16), or (I-18) as a charge transporting substance and 10 parts by weight of polycarbonate resin (Iupilon PCZ-300; manufactured by Mitsubishi Chemical Company Inc.), in which both compounds were dissolved in 80 parts by weight of tetrahydrofuran as a solvent, was applied to a surface of the charge generating layer and dried at 120° C. for 40 minutes to laminate a charge transporting layer having a dry thickness of 20 μm on the charge generating layer, resulting that a photosensitive layer was formed.

COMPARATIVE EXAMPLES 6, 8 AND 10

A photosensitive member was prepared by the same manner as described in the Example 10, except that a charge transporting substance having a composition represented by a chemical formula (III), (V) or (VII) was used in the Comparative Example 3 or 4, respectively.

EXAMPLES 11, 13, 15 AND 17

An aluminum cylinder having a mirror-grinded surface (an outer diameter of 60 mm, a length of 247 mm, a thickness of 1 mm) was dipped into 5% methanol solution of polyamide resin (Amiran CM-8000; Toray Industries, Inc.) to coat an under coating layer having a thickness of 0.1 μm on the surface of the cylinder. The cylinder having the under coating layer was further coated with another kind of a coating solution to be formed as a charge generating layer having a dry thickness of 0.7 μm on the under coating layer. This solution was prepared by that 1 part by weight of X-type metal-free phthalocyanine (Fastgen Blue 8120B; manufactured by Dainippon Ink and Chemicals Inc.) and 1 weight of polyvinylchrolide resin (MR-110; manufactured by Nippon Zeon CO., LTD. ) were added into 80 parts by weight of chloroform and dispersed them by a paint shaker for 100 minutes.

Then, the aluminum-deposited cylinder having the charge generating layer was further treated with a charge transporting material. That is, 10 parts by weight of indole derivative having a composition represented by a chemical formula (I-10), (I-12), (I-14), (I-16) or (I-18) as the charge transporting material and 10 parts by weight of polycarbonate resin (Iupilon; manufactured by Mitsubishi Gas Chemical Company Inc.) were dissolved in 80 parts by weight of tetrahydrofuran as a solvent. The coating solution thus obtained was applied on the charge generating layer by dipping the cylinder into the solution to form a charge transporting layer having a dry thickness of 20 μm. Consequently, a photosensitive member was produced.

COMPARATIVE EXAMPLES 7 AND 9

A photosensitive member was prepared by the same manner as described in the example 11, except that comparative compound having a composition represented by a chemical formula (IV) or (VI) were used in the Example 7 or 9, respectively.

Electrophotographic characteristics of the photosensitive members prepared by the Examples 11, 12, 16 and 18 and the Comparative Examples 6, 7 and 8 were evaluated by using a photocopying machine (Model SF9400; manufactured by Sharp Co., LTD. ) which was already on the market.

Initial dark and bright potential of the photosensitive member were fixed at −800 V and −100 V, respectively. A sensitivity of the photosensitive member was determined as a luminous energy of an irradiated light which was responsible for shifting the dark potential to the bright potential. Residual potential (Vr) was defined as a level of potential after the exposure with light at a luminous energy of 10 lx.s. This process was repeated 20,000 times and then the sensitivity and the residual potential were measured again. Obtained results were listed in Table 7.

TABLE 7

| | Initial period | | After the 20,000 repetitions | |
|---|---|---|---|---|
| | sensitivity (lx · s) | Vr (V) | sensitivity (lx · s) | Vr (V) |
| Examples | | | | |
| 10 | 0.6 | −7 | 0.7 | −8 |
| 12 | 0.5 | −8 | 0.6 | −7 |
| 14 | 0.9 | −14 | 1.0 | −13 |
| 16 | 0.8 | −5 | 1.0 | −8 |
| Comparative Examples | | | | |
| 6 | 2.0 | −2.0 | 3.0 | −50 |
| 8 | 1.2 | −35 | 1.9 | −65 |
| 10 | 0.8 | −25 | 1.7 | −50 |

Electrophotographic characteristics of photoconductive members prepared by the Examples 11, 13, 15 and 17 and the Comparative Examples 7 and 9 were evaluated by using a process-examination device for photosensitive members in which each photosensitive member was installed as a sample. The sample was negatively charged by corotoron at −60 V, and then it was rotated at a peripheral speed of 78.5 mm/sec. Initial potential ($V_0$) was defined as a level of potential at a pre-irradiation period. Bright potential was defined as a level of potential at 0.2 seconds after irradiation of light having an exposure wave length of 780 mm with a luminous flux density of 2 μJ/cm$^2$, and also residual potential was defined as a level of potential measured at 1.5 seconds after that.

This process was repeated 20,000 times and the characteristic changes were observed. Obtained results were listed in Table 8.

TABLE 8

| | Initial period | | | After the 20,000 repetitions | | |
|---|---|---|---|---|---|---|
| | Vo (V) | Vi (V) | Vr (V) | Vo (V) | Vi (V) | Vr (V) |
| Examples | | | | | | |
| 11 | −650 | −30 | −4 | −630 | −35 | −7 |
| 13 | −600 | −25 | −8 | −59 | −30 | −10 |
| 17 | −620 | −34 | −10 | −690 | −32 | −8 |
| Comparative Examples | | | | | | |
| 7 | −590 | −50 | −20 | −500 | −90 | −40 |
| 9 | −690 | −70 | −40 | −590 | −130 | −100 |

As shown in Tables 7 and 8, the photosensitive members in accordance with present invention are excellent in their durability against usage in frequency over long period.

The present invention has been described in detail with respect to preferred embodiments, and it will now be apparent from the foregoing to those skilled in the art that changes and modifications may be made without departing from the invention in its broader aspects, and it is the intention, therefore, in the appended claims to cover all such changes and modifications as fall within the true spirit of the invention.

What is claimed is:

1. A photosensitive member for electrophotography, comprising:

a conductive substrate having an electroconductive surface; and a photosensitive layer which is laminated on said conductive substrate and which is comprised of a charge generating substance, a charge transporting substance, and a binder resin, wherein the charge transporting substance is comprised of at least one indole derivative represented by a chemical formula (I):

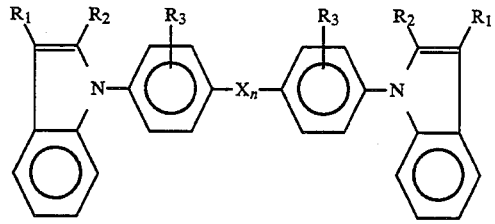

wherein $R_1$ and $R_2$ are groups selected from the group consisting of a hydrogen atom, and alkyl, aralkyl, allyl and alkoxy groups having 1–9 carbon atoms except that $R_1$ and $R_2$ do not both stand for hydrogen atoms; $R_3$ is a group selected from the group consisting of a hydrogen atom, a halogen atom, and alkyl and alkoxy groups having 1–3 carbon atoms; X is a group selected from the group consisting of alkylene, allylene, carbonyl, sulfonyl, sulfinyl and sulfide groups, and an oxygen atom; and n is an integer of 0 or 1.

2. The photosensitive member as claimed in claim 1, wherein $R_1$ stands for a methyl group, $R_2$stands for a methyl group, and $R_3$ stands for a hydrogen atom in said chemical formula (I) of said at least one indole derivative.

3. The photosensitive member as claimed in claim 1, wherein $R_1$ stands for a hydrogen atom, $R_2$stands for a methyl group, and $R_3$ stands for a hydrogen atom in said chemical formula (I) of said at least one indole derivative.

4. The photosensitive member as claimed in claim 1, wherein $R_1$ stands for a methyl group, $R_2$stands for a hydrogen atom, and $R_3$ stands for a hydrogen atom in said chemical formula (1) of said at least one indole derivative.

5. The photosensitive member as claimed in claim 1, wherein said conductive substrate is made of a metallic material selected from the group consisting of aluminum, stainless steel and nickel.

6. The photosensitive member as claimed in claim 1, wherein said conductive substrate is made of a non-conductive material having a surface treated to be electroconductive by a treatment by one of metal deposition, metal plating, and application of an electroconductive paint.

7. The photosensitive member as claimed in claim 1, wherein said photosensitive layer is a monolayer consisting of a single layer having functions including maintaining a surface electric charge in the dark, generating electric charge upon receiving light, and transporting said electric charge upon receiving light.

8. The photosensitive member as claimed in claim 7, wherein said monolayer has a thickness ranging from 10–40 μm.

9. The photosensitive member as claimed in claim 7, wherein said monolayer comprises 10–100 weight % of the charge transporting substance and 1–10 weight % of the charge generating substance.

10. The photosensitive member as claimed in claim 1, wherein said binder resin is an electrically-insulating, laminatable material selected from the group consisting of polycarbonates, polyesters, polyamides, polyurethanes, epoxy resins, methacrylate homo- and copolymers, and mixtures thereof.

11. The photosensitive member as claimed in claim 9, wherein said charge generating substance is at least one substance selected from the group consisting of a metal-free phthalocyanine pigment, a metal-free titanylphthalocyanine pigment, an azo pigment, a quinone pigment, an indigo pigment, a cyanine compound, a squaryllium compound, an azulenium a compound, a pyrylium compound, selenium, and a selenium compound.

12. The photosensitive member as claimed in claim 1, wherein said photosensitive layer is a laminate consisting of a charge generating layer comprising a charge generating substance for generating electric charge; and a charge transporting layer comprising the charge transporting substance of claim 1 for transporting said electric charge upon receiving light.

13. The photosensitive member as claimed in claim 12, wherein said charge generating layer has a dry thickness ranging from 0.01 to 3.0 μm.

14. The photosensitive member as claimed in claim 12, wherein said charge transporting layer has a dry thickness ranging from 5 to 50 μm.

15. The photosensitive member as claimed in claim 12, wherein said charge transporting layer further comprises a binder resin and is formed on said charge generating layer, and wherein said charge transporting layer comprises from 10–100 weight % of said charge transporting substance and more than 30 weight % of said binder resin per total volume of said charge transporting layer.

16. The photosensitive member as claimed in claim 12, wherein said charge generating substance is at least one substance selected from the group consisting of a metal-free phthalocyanine pigment, a metal-free titanylphtalocyanine pigment, an azo pigment, a quinone pigment, an indigo pigment, a cyanine compound, a squaryllium compound, an azulenium compound, a pyrylium compound, selenium, and a selenium compound.

17. The photosensitive member as claimed in claim 1, wherein said n is 0 in said chemical formula (I).

18. The photosensitive member as claimed in claim 7, wherein said monolayer has a thickness ranging from 20–30 μm.

19. The photosensitive member as claimed in claim 12, wherein said charge generating layer has a dry thickness ranging from 0.01 to 1.0 μm.

20. The photosensitive member as claimed in claim 14, wherein said charge transporting layer has a dry thickness ranging 10 to 40 μm.

* * * * *